US006851204B2

(12) United States Patent
Aveni et al.

(10) Patent No.: US 6,851,204 B2
(45) Date of Patent: Feb. 8, 2005

(54) FOOTWEAR SOLE WITH A STIFFNESS ADJUSTMENT MECHANISM

(75) Inventors: Michael A. Aveni, Lake Oswego, OR (US); David Grelewicz, Tigard, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/991,265

(22) Filed: Nov. 15, 2001

(65) Prior Publication Data

US 2004/0261292 A1 Dec. 30, 2004

(51) Int. Cl.[7] ..... A43B 13/18; A43B 5/00

(52) U.S. Cl. ..... 36/28; 36/35 R; 36/37; 36/114

(58) Field of Search ..... 36/27, 28, 29, 36/35 R, 37, 35 B, 38, 7.8, 31, 92, 88, 114

(56) References Cited

U.S. PATENT DOCUMENTS 6,457,261 B1 * 10/2002 Crary ..... 36/27
6,487,796 B1 * 12/2002 Avar et al. ..... 36/29

* cited by examiner

*Primary Examiner*—Anthony Stashick
(74) *Attorney, Agent, or Firm*—Banner & Witcoff, Ltd.

(57) ABSTRACT

The invention is an article of footwear having a sole comprised of one or more support elements formed of a resilient, compressible material. The support elements are designed such that the positions of one or more bands that encircle the exterior surface of the support elements may be altered such that the deflection characteristics of the support elements are changed. In order to facilitate the repositioning of the bands, the support element includes an access indentation defined by the exterior surface or flanges that are secured to each band.

36 Claims, 13 Drawing Sheets

FOOTWEAR SOLE WITH A STIFFNESS ADJUSTMENT MECHANISM

BACKGROUND OF THE INVENTION

1. Field of the Invention

The present invention relates to footwear. The invention concerns, more particularly, a sole for footwear that includes a mechanism for adjusting stiffness characteristics of the sole.

2. Description of Background Art

Sole design for modern athletic footwear is generally characterized by a multi-layer construction that includes an outsole, midsole, and insole. The midsole typically includes a soft, foam material to attenuate impact forces and absorb energy when the footwear contacts the ground during athletic activities. Other prior art midsoles utilize fluid or gas-filled bladders of the type disclosed in U.S. Pat. Nos. 4,183,156 and 4,219,945 to Marion F. Rudy. Although foam materials succeed in providing cushioning for the foot, foam materials also impart instability that increases in proportion to midsole thickness. For this reason, footwear design often involves a balance of cushioning and stability.

The typical motion of the foot during running proceeds as follows. First, the heel strikes the ground, followed by the ball of the foot. As the heel leaves the ground, the foot rolls forward so that the toes make contact, and finally the entire foot leaves the ground to begin another cycle. During the time that the foot is in contact with the ground, it typically rolls from the outside or lateral side to the inside or medial side, a process called pronation. That is, normally, the outside of the heel strikes first and the toes on the inside of the foot leave the ground last. While the foot is air borne and preparing for another cycle the opposite process, called supination, occurs. Pronation, the inward roll of the foot while in contact with the ground, although normal, can be a potential source of foot and leg injury, particularly if it is excessive. The use of soft cushioning materials in the midsole of running shoes, while providing protection against impact forces, can encourage instability of the sub-talar joint of the ankle, thereby contributing to the tendency for over-pronation. This instability has been cited as a contributor to "runners knee" and other athletic injuries.

Various methods for resisting excessive pronation or instability of the sub-talar joint have been proposed and incorporated into prior art athletic shoes as stability devices. In general, these devices have been fashioned by modifying conventional shoe components, such as the heel counter and midsole material, or adding a pronation control device to the midsole. Examples of these techniques are found in U.S. Pat. Nos. 4,288,929; 4,354,318; 4,255,877; 4,287,675; 4,364,188; 4,364,189; 4,297,797; 4,445,283; and 5,247,742.

Stabilization is also a factor in sports like basketball, volleyball, football, and soccer. In addition to running, an athlete may be required to perform a variety of motions including lateral movement; quickly executed direction changes, stops, and starts; movement in a backwards direction; and jumping. While making such movements, footwear instability may lead to excessive inversion or eversion of the ankle joint, a primary cause of ankle sprain. For example, an athlete may be required to perform a rapid, lateral movement on a surface with friction characteristics that prevents sliding of the sole relative to the surface. Upon contact with the surface, the lateral portion of the foot impacts the interior of the footwear causing the lateral side of the midsole to compress substantially more than the medial side. The downward incline on the interior of the footwear caused by the differential compression, in conjunction with the momentum of the athlete's body, creates a situation wherein the shoe rolls towards the lateral side, causing an ankle sprain. Similar situations which cause excessive inversion or eversion comprise one common type of injury associated with athletic activities. A shoe with high lateral (side-to-side) stability will minimize the effects of differential compression by returning to a condition of equilibrium wherein the foot is centered over the sole.

The preceding example particularly arises when footwear incorporates a midsole with cushioning qualities that do not provide sufficient stability. In order to compensate for a lack of stability, designers often incorporate devices into the upper that increase stiffness. These devices attempt to provide a stable upper to compensate for an instability in the sole. Such devices take the form of rigid members, elastic materials, or straps that add to the overall weight of the footwear, make the article of footwear cumbersome, or restrict plantar flexion and dorsi flexion. For example, U.S. Pat. No. 4,989,350 to Bunch et al. discloses an article of footwear with sheet springs attached to the ankle portion, and U.S. Pat. No. 5,152,082 to Culpepper discloses an ankle support including a plurality of stiff projections extending along the heel and ankle. U.S. Pat. No. 5,896,683 to Foxen et al. discloses a support in the form of a plurality of finger-like elements attached to the upper which does not add significant weight to the shoe and allows plantar and dorsi flexion.

U.S. Pat. Nos. 5,353,523 and 5,343,639 to Kilgore et al., which are hereby incorporated by reference, discloses an article of athletic footwear with a midsole that includes foam columns placed between rigid upper and lower plates. FIG. 1 depicts a prior art shoe 10 that includes an upper 12 which is attached to a sole 14. In addition to outsole layer 20, sole 14 includes a midsole 18 that incorporates four support elements 32. Midsole 18 also includes footframe 23, cushioning and stability component 24, midfoot wedge 40, and cushioning layer 22 which is formed from a cushioning material such as ethyl vinyl acetate or non-microcellular polyurethane foam and extends throughout at least the forefoot portion of shoe 10.

Cushioning and stability component 24 includes shell or envelope 26 having upper and lower plates 28 and 30, defining therebetween an open area of the sole, and a plurality of compliant elastomeric support elements 32 disposed in the open area. FIGS. 2 illustrate three configurations for envelope 26. In one embodiment of this prior art shoe, support elements 32 have the shape of hollow, cylindrical columns or columns containing a plurality of interior voids.

The outer surface of support elements 32 may include a plurality of spaced grooves that removably receive bands 36 and ensure uniform vertical deflection. Columns designed with straight walls that do not contain grooves have a greater tendency to buckle. Furthermore, the compliance of the columns and the overall stiffness of the midsole may be adjusted through use of bands 36 that are retained by the grooves. Generally, bands 36 that are located in a centrally located groove increase the stiffness of support element 32. By moving band 36 out of the groove and positioning band 36 near the top or bottom of support element 32, the stiffness is decreased. In this manner, the wearer may individually tune the stiffness of the midsole to his own requirements, taking into account body weight and the activity for which the shoe will be used.

Although bands 36 provide an effective method of adjusting the stiffness of support element 32, the prior art designs are difficult for a wearer to adjust. In order to have a practical effect upon stiffness, bands 36 must significantly constrict support element 32. The considerable effort that is necessary to alter the configuration of bands 36 inhibits wearers from properly adjusting the stiffness of support elements 32. Accordingly, the art requires a system for adjusting stiffness wherein a wearer may easily alter the configuration of the bands that circumscribe support elements 32.

BRIEF SUMMARY OF THE INVENTION

The present invention is an article of footwear that includes an upper for receiving a foot of a wearer and a sole attached to the upper. The sole incorporates at least one support element that includes an exterior surface, at least one band that encircles the exterior surface, and a structure that facilitates movable positioning of the band with respect to the exterior surface to thereby alter deflection and stiffness characteristics of the support element.

In a first embodiment of the invention a flange extends outward from the band. The purpose of the flange is to permit the wearer to gain a secure grip upon the band when repositioning the band. In a second embodiment of the invention, each support element includes an access indentation inscribed in the exterior surface. The purpose of the access indentation is to facilitate repositioning of the band along the length of the support element by permitting the wearer to effectively gain control of the band. Because the band encircles the exterior surface and restricts outward movement of the support element, positioning of the band in an area of high support element deflection restricts such deflection, thereby increasing the stiffness of the support element. In order to ensure that the band remains in the chosen position, band indentations may extend around the support element. Accordingly, the wearer may position the band in one of a plurality of possible positions, potentially defined by the band indentations, to adjust deflection and stiffness characteristics of the sole.

This system may also be used in conjunction with multiple bands. If two bands encircle an individual support element, maximum stiffness may be achieved by positioning both bands in the area of maximum deflection upon impact. Minimum stiffness may be achieved by positioning both bands in areas of minimal deflection. Intermediate stiffnesses may be achieved by positioning one band in the area of maximum deflection and the other band in an area of low deflection. Stiffness characteristics may be further altered by positioning both bands in areas of intermediate deflection. Accordingly, multiple bands may be cooperatively used to adjust the stiffness of an individual support element.

In addition to support elements that have a flat upper surface, as disclosed in the '523 and '639 patents, and are most suitable for sports that include primarily running, the support elements of the present invention may also include support elements with canted upper surfaces. Such support elements are most suitable for footwear used in basketball or other court-style sports.

The various advantages and features of novelty that characterize the present invention are pointed out with particularity in the appended claims. To gain an improved understanding of the advantages and features of novelty that characterize the present invention, however, reference should be made to the descriptive matter and accompanying drawings which describe and illustrate preferred embodiments of the invention.

DETAILED DESCRIPTION OF THE INVENTION

Referring to the FIGS. 3–25, wherein like numerals indicate like elements, articles of footwear in accordance with the present invention are illustrated. The present invention relates generally to footwear having support elements disposed in the sole. At least one band encircles each support element and restricts outward deflection of the support element during compression. By repositioning the band in relation to the exterior surface of the support element, the stiffness characteristics of the support element may be adjusted by the wearer. In a first embodiment, repositioning of the band is facilitated by a structure, such as a graspable flange, that is attached to the band. In a second embodiment, the support element is structured to facilitate repositioning of the band by, for example, an access indentation located in the exterior surface of the support element.

The present invention is applicable to a wide variety of footwear having support elements disposed in the sole. Depending upon the primary use for the footwear, the support elements may include either a flat or canted upper surface. For general information relating to footwear having support elements with a flat upper surface, see U.S. Pat. Nos. 5,353,523 and 5,343,639 to Kilgore et al., incorporated by reference. For general information relating to footwear having a canted upper surface see the detailed discussion concerning the first embodiment, included herein.

Figure 9:
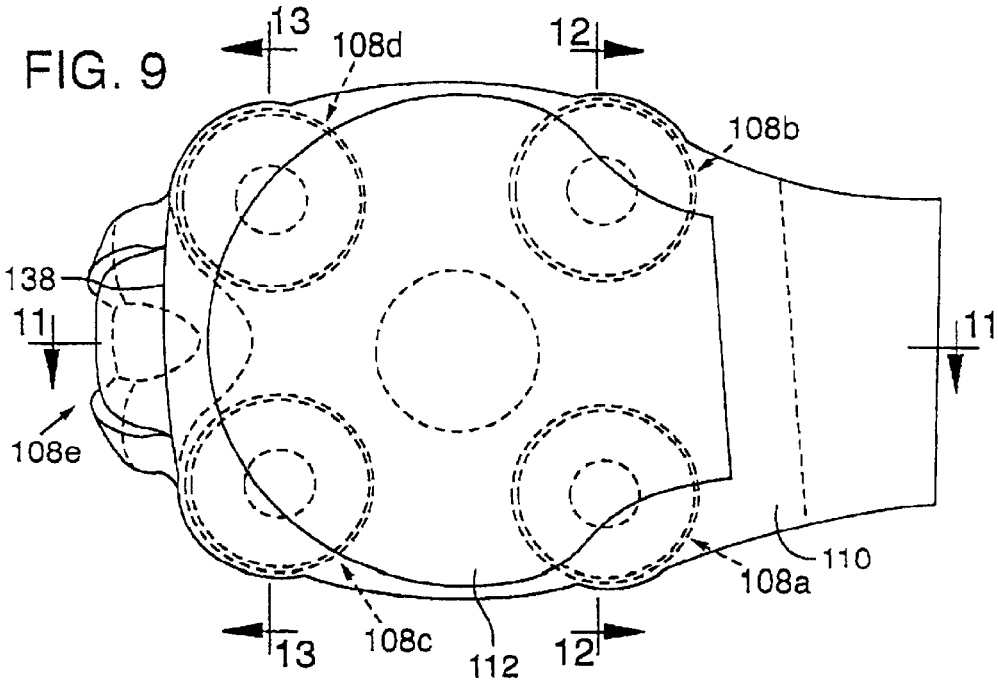
FIG. 9 is a bottom plan view of the stability component depicted in FIG. 6.
Figure 10:
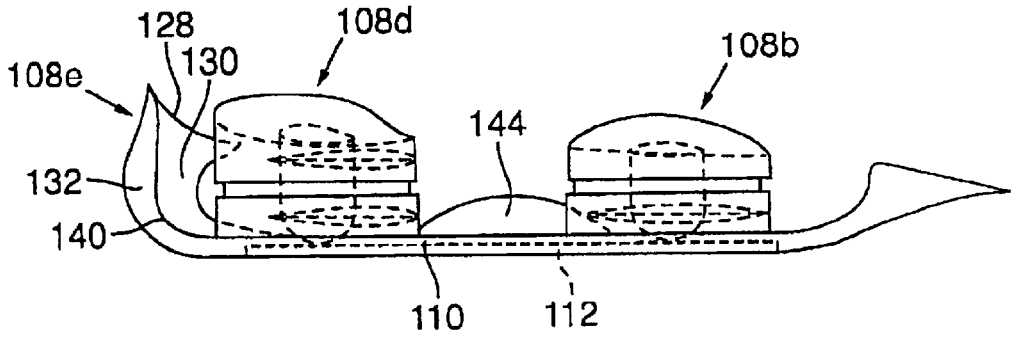
FIG. 10 is a side view of the stability component depicted in FIG. 6.
Figure 11:
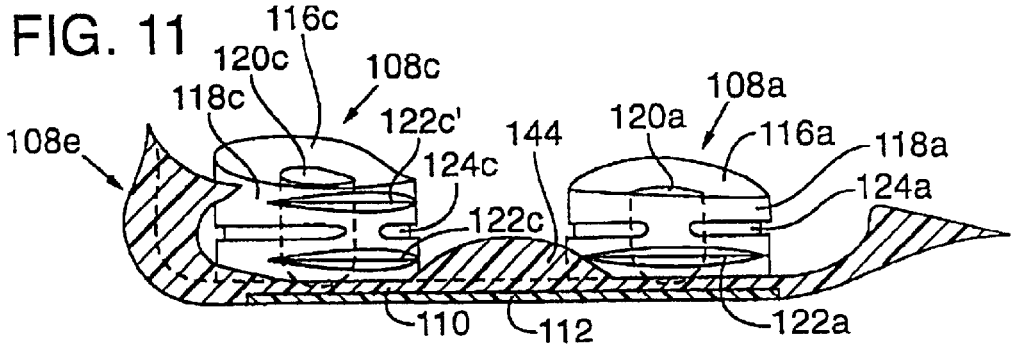
FIG. 11 is a cross-sectional view generally along line 1—1 of FIG. 9.
Figure 12:
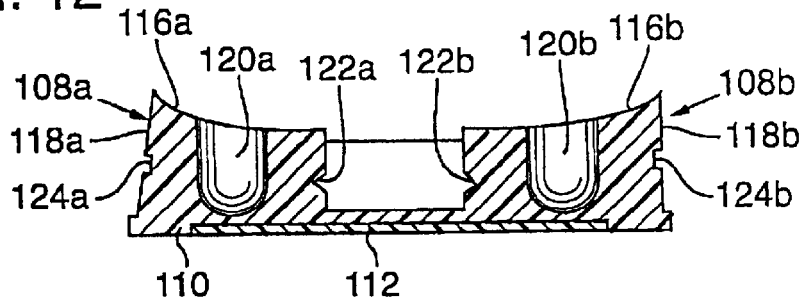
FIG. 12 is a cross-sectional view generally along line 12—12 of FIG. 9.
Figure 13:
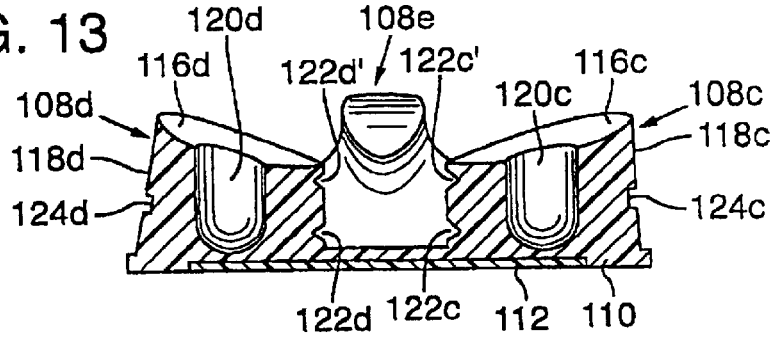
FIG. 13 is a cross-sectional view generally along line 13—13 of FIG. 9.

Support elements in accordance with a first embodiment of the present invention are disclosed in FIGS. 3–19. Shoe 100 includes three primary components: upper 102, heel plate 104, and sole 106. Sole 106 is further comprised of support elements 108, including columns 108*a*–108*d* and aft support 108*e*, base 110, base plate 112 (not visible), and outsole 114. Upper 102 is attached to heel plate 104 in the aft portion of shoe 100 and outsole 114 in fore portions of shoe 100. Heel plate 104 is affixed to the upper surface of support elements 108. Underlying support elements 108, and formed integral therewith, is base 110. Located between base 110 and outsole 114 is base plate 112, as depicted in FIG. 9. A cavity in sole 106 is defined by the space between heel plate 104 and base 110 that is not occupied by support elements 108.

FIGS. 6–13 depict support elements 108 and base 110 which are molded as a single component. Alternatively, support elements 108 may be formed independently of base 110 and subsequently attached through adhesive bonding, for example.

Columns 108*a*–108*d* are generally positioned with respect to an average foot structure. As such, columns 108*a*–108*d* are positioned such that a midpoint 111 between the centers of columns 108*a*–108*d* generally corresponds with a point below the calcaneus of the wearer. Individual column placement is as follows: column 108*a* is generally positioned on a lateral side of shoe 100 adjacent to a fore portion of the calcaneus; column 108*b* is generally positioned on a medial side of shoe 100 adjacent to a fore portion of the calcaneus; column 108*c* is generally positioned on a lateral side of shoe 100 adjacent to an aft portion of the calcaneus; and column 108*d* is generally positioned on a medial side of shoe 100 adjacent to an aft portion of the calcaneus.

Columns 108*a*–108*d* each have an upper surface 116, an external vertical surface 118, an interior void 120, one or more flexion indentations 122, and a band indentation 124. With respect to column 108*a*, upper surface 116*a* is defined by a downwardly curving cant in the direction indicated by arrow 113*a*. Accordingly, portions of upper surface 116*a* located adjacent the exterior of shoe 100 are at a greater elevation than other portions of upper surface 116*a*. Column 108*a* also includes a cylindrically shaped interior void 120*a* located on the central axis of column 108*a* and extending downward from upper surface 116*a*. Flexion indentation 122*a* is a horizontal indentation in vertical surface 118*a* that extends around approximately one-third of the circumference of column 108*a*. The linear center of flexion indentation 122*a* may be located adjacent to the base of column 108*a* and below the intersection of arrow 113*a* with vertical surface 118*a*.

Band indentation 124*a* is a horizontal indentation in vertical surface 118*a* that extends around a majority of the circumference of column 108*a*. The area in the circumference of column 108*a* where band indentation 124*a* is absent may be centered generally above the linear center of flexion indentation 122*a*. A band 126*a*, which has the shape of a ring, is received by band indentation 124*a*. Band 126*a* includes flange 127*a* for repositioning band 126*a* with respect to column 108*a*. By grasping flange 127*a*, the wearer may move band 126*a* to a different location, thereby adjusting the stiffness of column 108*a*, as discussed below.

The characteristics of column 108*b* are similar to those discussed in reference to column 108*a*. Accordingly, column 108*b* includes upper surface 116*b*, exterior vertical surface 118*b*, interior void 120*b*, flexion indentation 122*b*, band indentation 124*b*, band 126*b*, and flange 127*b*. As with band 126*a*, the wearer may utilize flange 127*b* to reposition band 126*b* and thereby adjust the stiffness characteristics of column 108*b*.

With respect to column 108*c*, upper surface 116*c* is defined by a downwardly curving cant in the direction indicated by arrow 115*c*. Accordingly, portions of upper surface 116*c* located adjacent the exterior of shoe 100 are at a greater elevation than other portions of upper surface 116*c*. Column 108*c* also includes a cylindrically shaped interior void 120*c* located on the central axis of column 108*c* and extending downward from upper surface 116*c*. Flexion indentations 122*c* and 122*c*' are horizontal indentations in vertical surface 118*c* that extend around approximately one-third of the circumference of column 108*c*. The linear centers of flexion indentations 122*c* and 122*c*' are located below the intersection of arrow 113*a* with vertical surface 118*a*. With respect to vertical placement, flexion indentation 122*c* is located adjacent to the base of column 108*c* and flexion indentation 122*c*' is located adjacent to the upper surface 116*c*.

Band indentation 124*c* is a horizontal indentation in vertical surface 118*c* that extends around a majority of the circumference of column 108*c*. The area in the circumference of column 108*c* where band indentation 124*c* is absent is centered generally between the linear centers of flexion indentations 122*c* and 122*c*'. Received in band indentation 124*c* is band 126*c* formed of a resilient, elastic material and with a natural, unstretched or uncompressed diameter that is less than the diameter of column 108*c*. Attached to band 126*c* is flange 127*c*.

The characteristics of column 108*d* are similar to those discussed in reference to column 108*c*. Accordingly, column 108*d* includes upper surface 116*d*, exterior vertical surface 118*d*, interior void 120*d*, flexion indentation 122*d*, band indentation 124*d*, band 126*d*, and flange 127*d*. As with band 126*c*, the wearer may use flange 127*d* to reposition band 126*d* and thereby adjust the stiffness characteristics of column 108*d*.

With reference to FIGS. 9–13, base plate 112 is shown imbedded within an indentation in the lower surface of base 110. The material comprising base plate 112 may be a short glass fiber reinforced nylon 6 or 66 with sufficient toughness to prevent piercing by objects on the ground.

Figure 1:
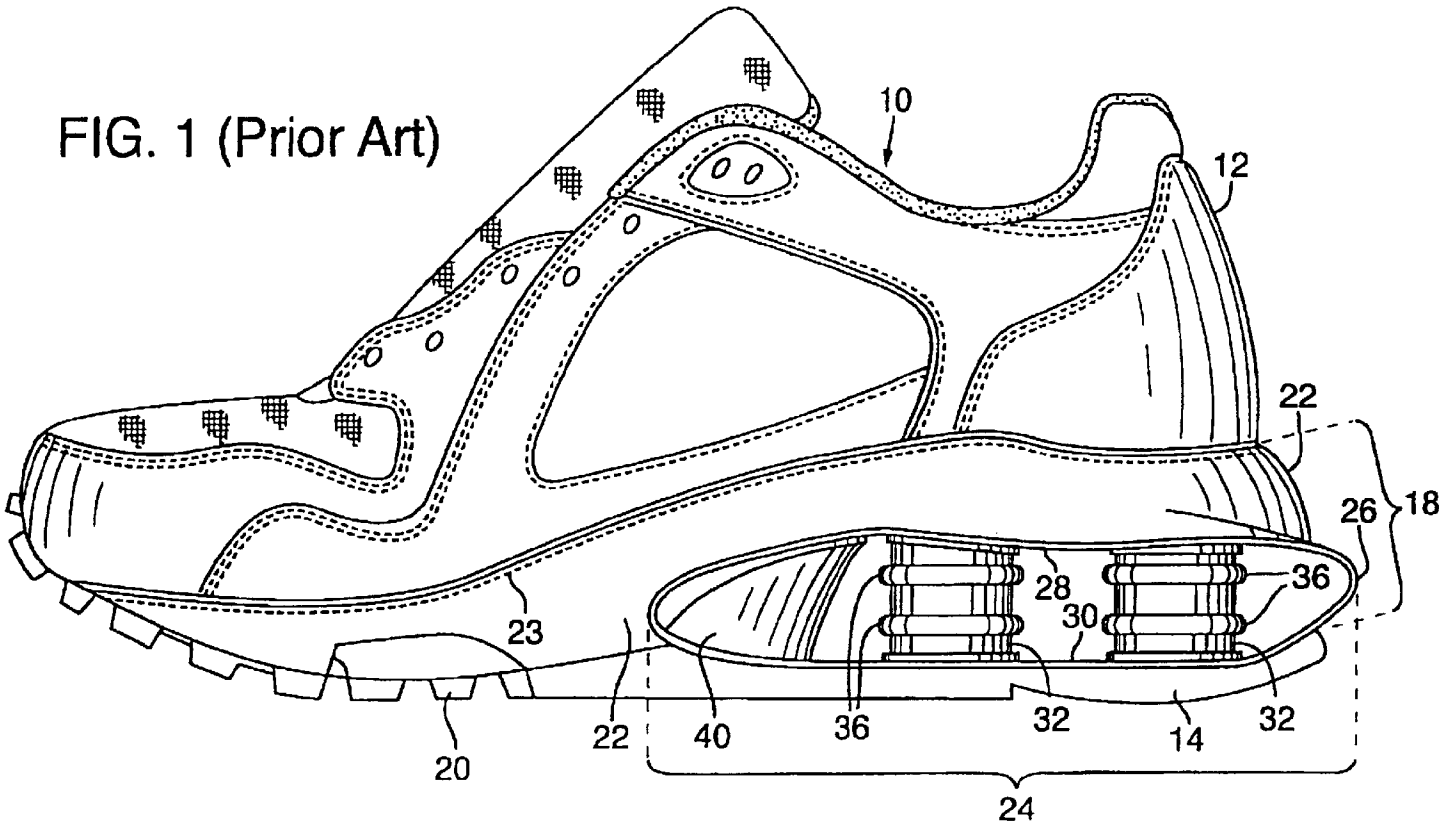
FIG. 1 (Prior Art)
FIG. 1 is a lateral elevational view of a prior art article of footwear.
Figure 2A:
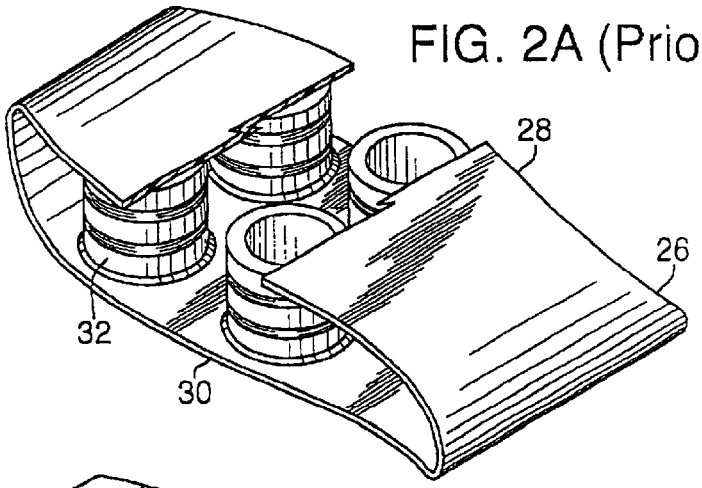
FIG. 2A (Prior Art)
FIGS. 2*a*–2*c* are perspective views of cushioning and stability components in accordance with three embodiments of the prior art article of footwear.
Figure 2B:
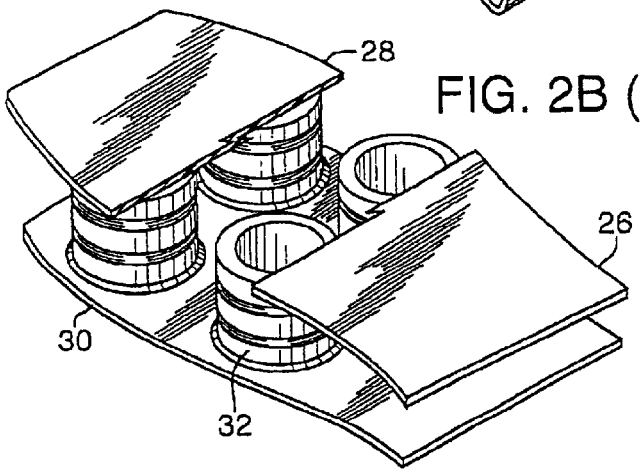
FIG. 2B (Prior Art)
Figure 2C:
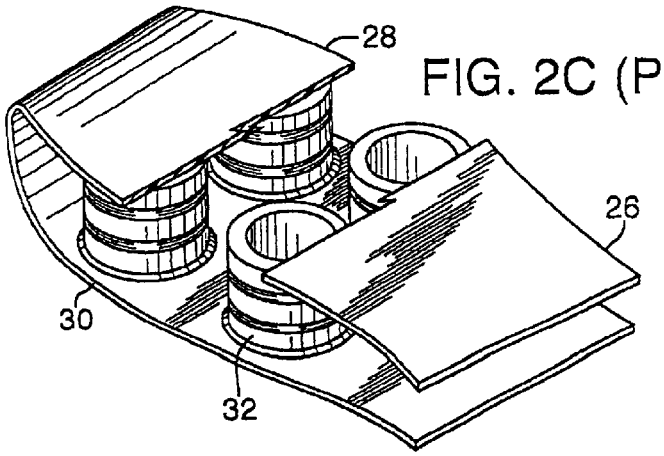
FIG. 2C (Prior Art)
Figure 3:
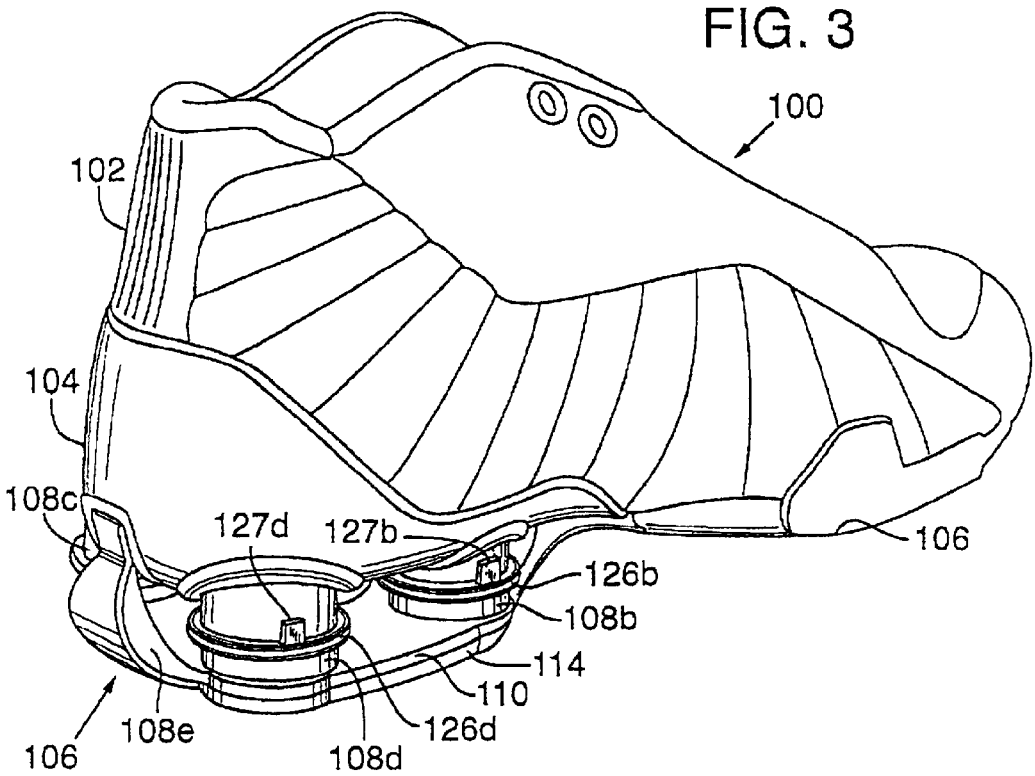
FIG. 3 is a medial and aft perspective view of an article of footwear according to a first embodiment of the present invention.
Figure 4:
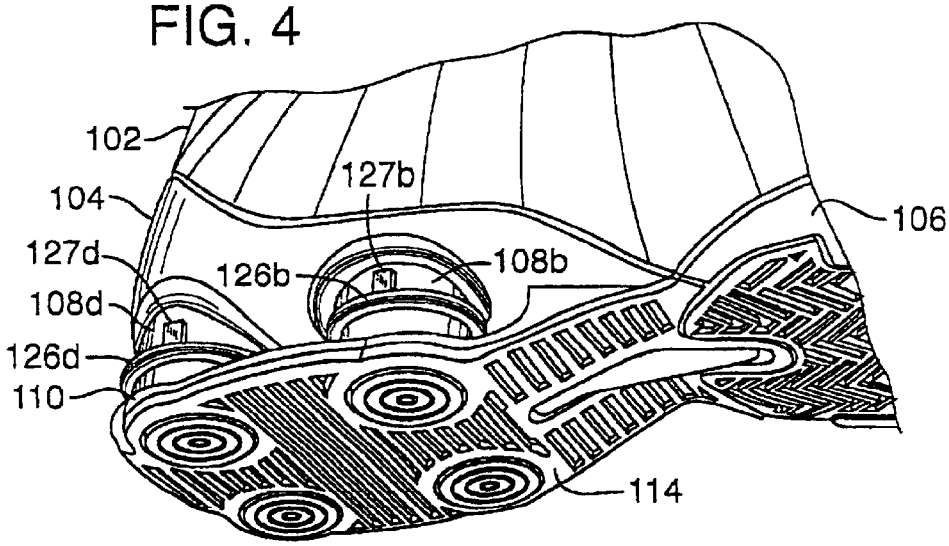
FIG. 4 is a medial and bottom perspective view of the footwear depicted in FIG. 3.
Figure 5:
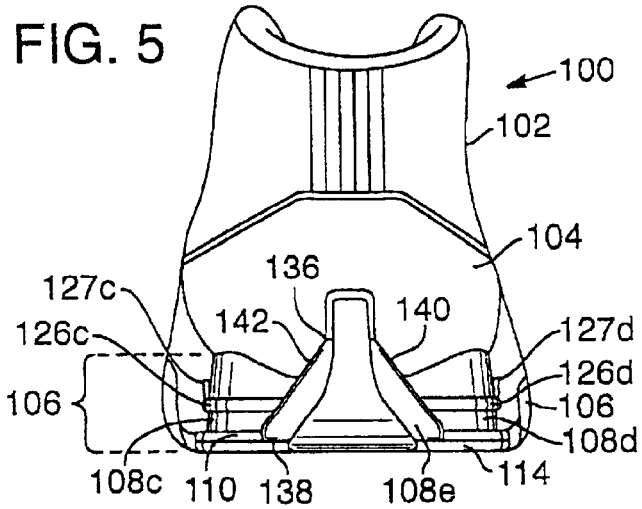
FIG. 5 is an aft view of the footwear depicted in FIG. 3.
Figure 6:
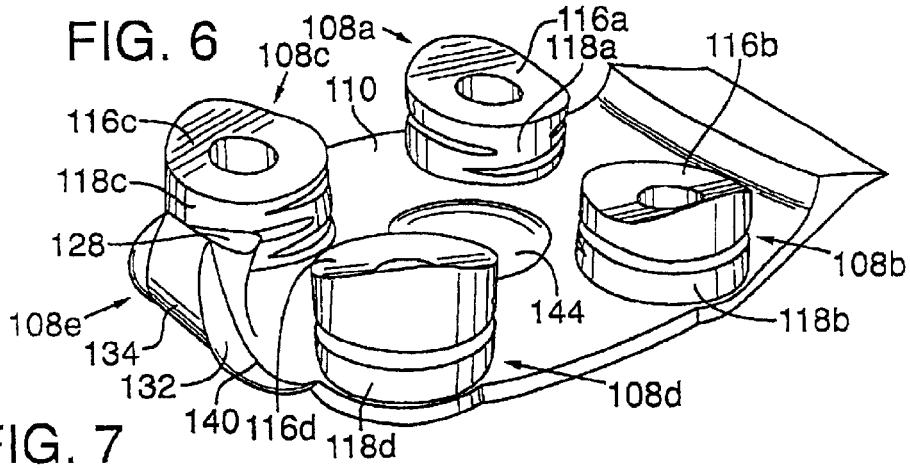
FIG. 6 is a perspective view of a stability component according to the first embodiment of the present invention.
Figure 7:
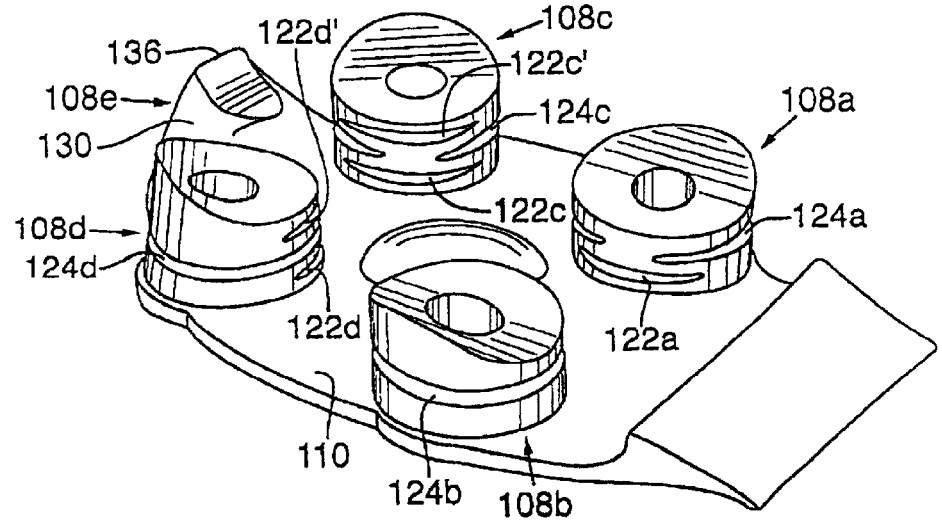
FIG. 7 is a second perspective view of the stability component depicted in FIG. 6.
Figure 8:
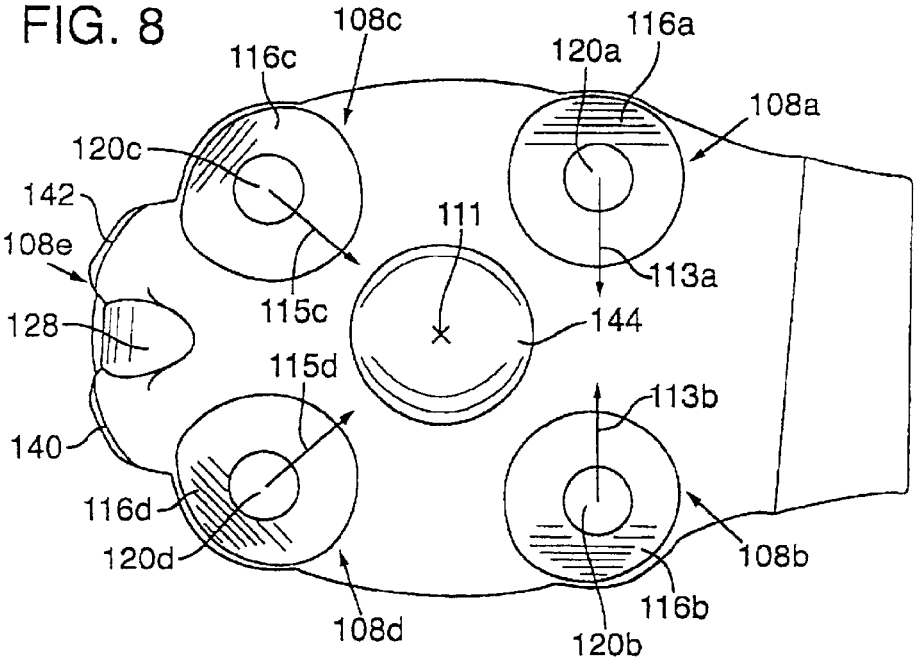
FIG. 8 is a top plan view of the stability component depicted in FIG. 6.

Aft support 108*e* is located in the aft portion of shoe 100 on the centerline of the heel area of the sole. Aft support 108*e* has an upper surface 128, a fore surface 130, an aft surface 132, and an outsole indentation 134. Upper surface 128 is defined by a downwardly curving cant directed toward the interior of shoe 100. The slope of the downwardly curving cant decreases to approximately zero as upper surface 128 approaches the fore surface 130. Fore surface 130 is a concave surface in the vertical direction that faces fore portions of shoe 100. Aft surface 132 has a general convex shape in the vertical direction that faces outwardly from shoe 100. As shown in FIG. 5, the boundaries of aft surface 132 are a parallel upper edge 136 and lower edge 138. In addition, medial edge 140 and lateral edge 142 are inclined inward such that upper edge 136 is of lesser length than lower edge 138. Additionally, the width of lower edge 138 is in the range of three to five times greater than the distance between fore surface 130 and aft surface 132.

Underlying and attached to base 110 and base plate 112 is outsole 114. An extension of outsole 114 wraps around aft surface 132 of aft support 108*e*, the extension fitting into, and attaching to, outsole indentation 134.

Protrusion 144, located between columns 108, is a convex portion of base 110 extending upward from the upper surface of base 110. If an impact force should be of a magnitude that excessively compresses support elements 108, heel plate 104 will contact protrusion 144, thereby preventing downward motion of heel 104 plate so as to contact base 110.

A suitable material for support elements 108, base 110, protrusion 144 is an elastomer such as rubber, polyurethane foam, or microcellular foam having specific gravity of 0.63 to 0.67 g/cm$^3$, hardness of 70 to 76 on the Asker C scale, and stiffness of 110 to 130 kN/m at 60% compression. The material can return 35 to 70% of energy in a drop ball rebound test, but energy return in the range of 55 to 65% is preferred. Furthermore, the material may have sufficient durability to maintain structural integrity when repeatedly compressed from 50 to 70% of natural height, for example, in excess of 500,000 cycles. Such a microcellular foam is available from the HUNTSMAN POLYURETHANE'S Company of Belgium. Alternatively, a microcellular elastomeric foam of the type disclosed in U.S. Pat. No. 5,343,639 to Kilgore et al., which has been incorporated by reference and discussed in the Background of the Invention herein, may be used.

Figure 14:
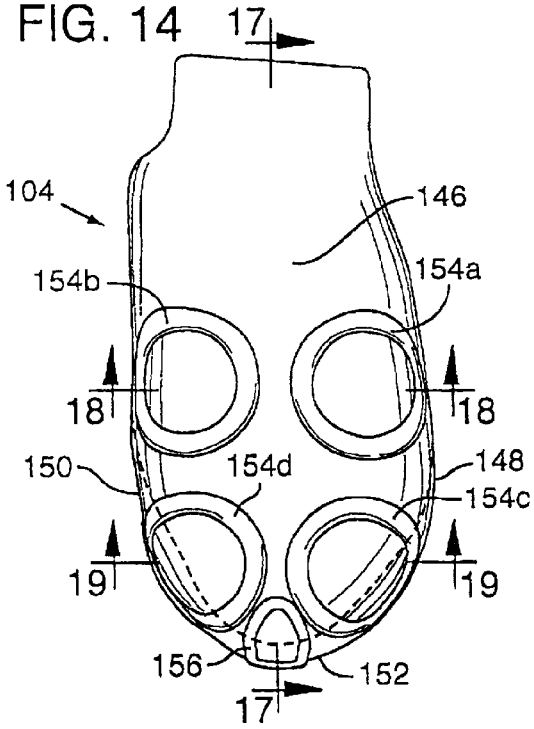
FIG. 14 is a bottom plan view of a heel plate according to the first embodiment of the present invention.
Figure 15:
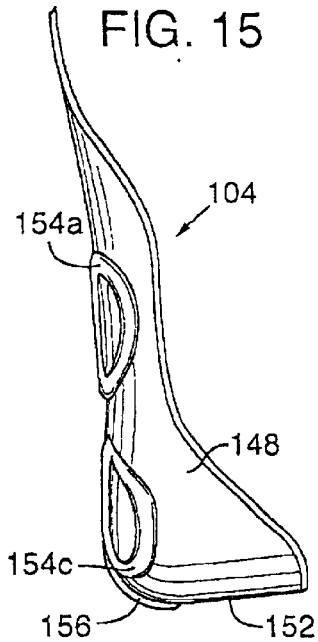
FIG. 15 is a lateral elevational view of the heel plate depicted in FIG. 14.
Figure 16:
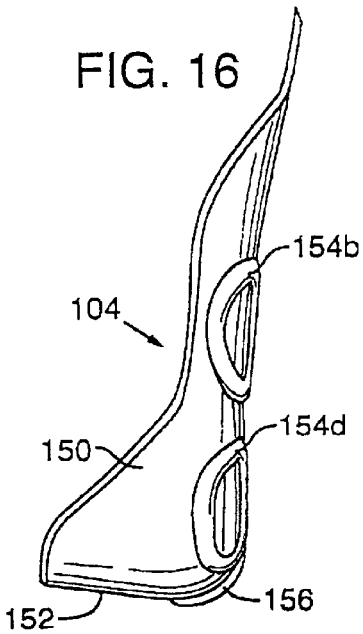
FIG. 16 is a medial elevational view of the heel plate depicted in FIG. 14.
Figure 17:
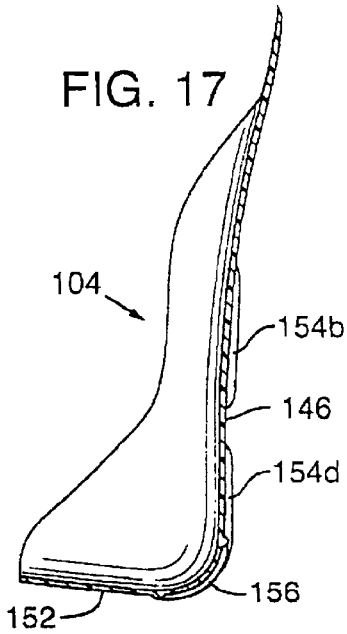
FIG. 17 is a cross-sectional view along line 17—17 of FIG. 14.
Figure 19:
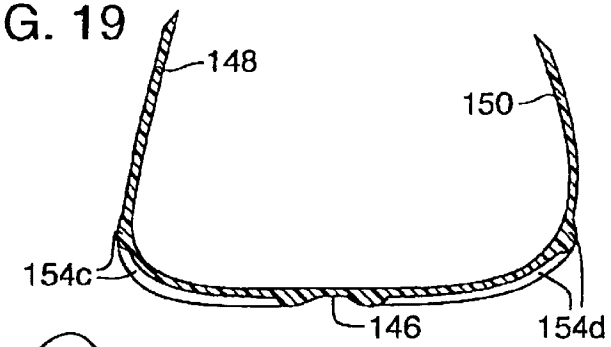
FIG. 19 is a cross-sectional view along line 19—19 of FIG. 14.
Figure 18:
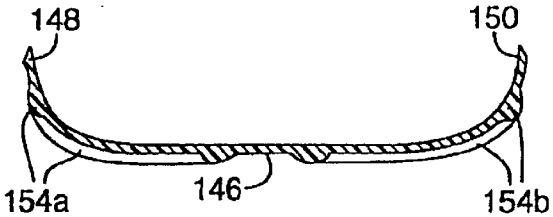
FIG. 18 is a cross-sectional view along line 19—19 of FIG. 14.
Figure 20A:
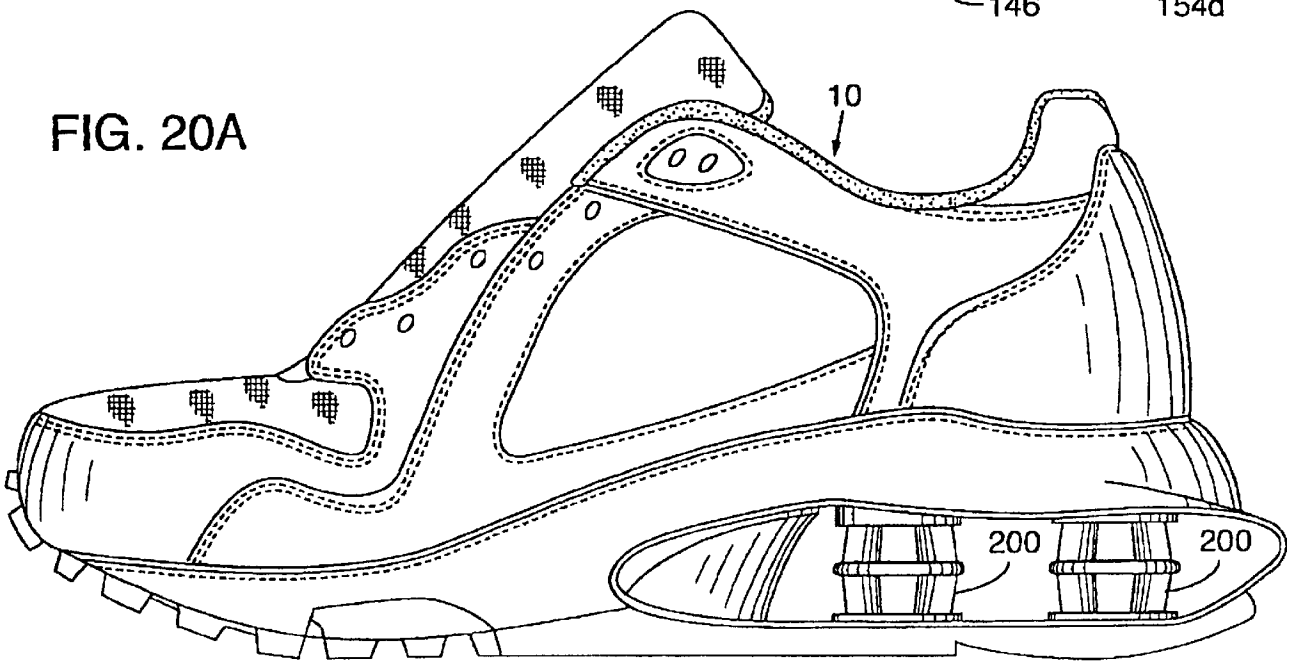
FIG. 20A is a side view of an article of footwear including support elements according to a second embodiment of the present invention.
Figure 20B:
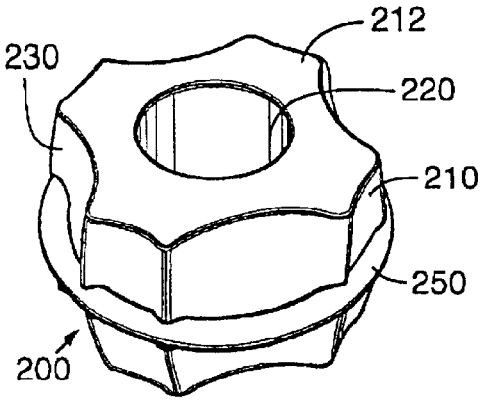
FIG. 20B is a perspective view of an individual support element according to the second embodiment of the present invention.
Figure 20C:
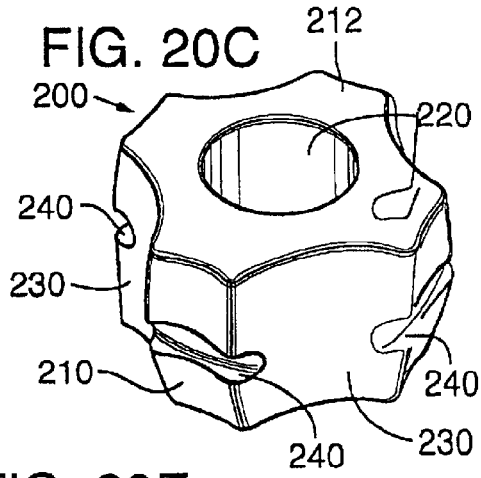
FIG. 20C is a perspective view of the support element of FIG. 20B with the band removed.
Figure 20D:
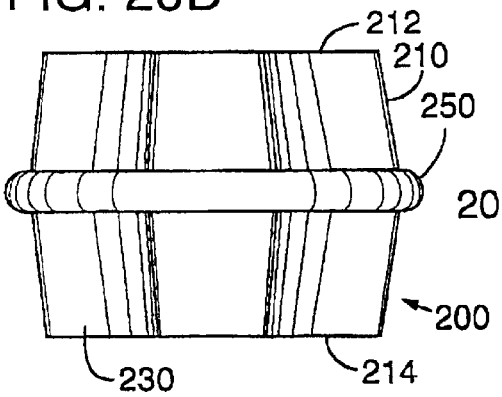
FIG. 20D is an elevational view of the support element of FIG. 20B.
Figure 20E:
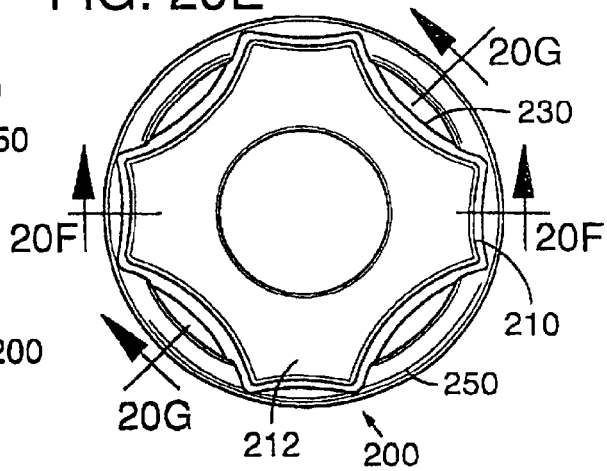
FIG. 20E is a top plan view of the support element of FIG. 20B.
Figure 20F:
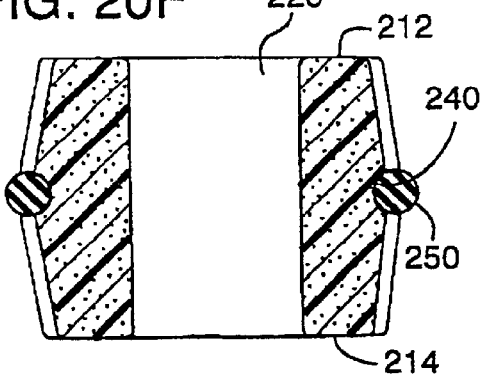
FIG. 20F is a cross-sectional view along line 20F—20F of FIG. 20E.
Figure 20G:
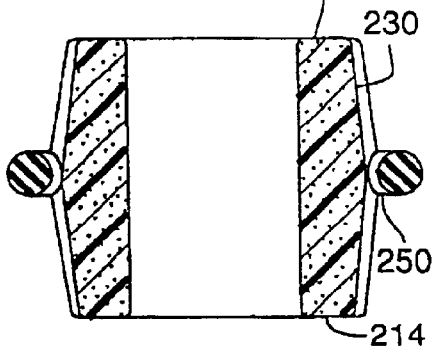
FIG. 20G is a cross-sectional view along line 20G—20G of FIG. 20E.
Figure 21A:
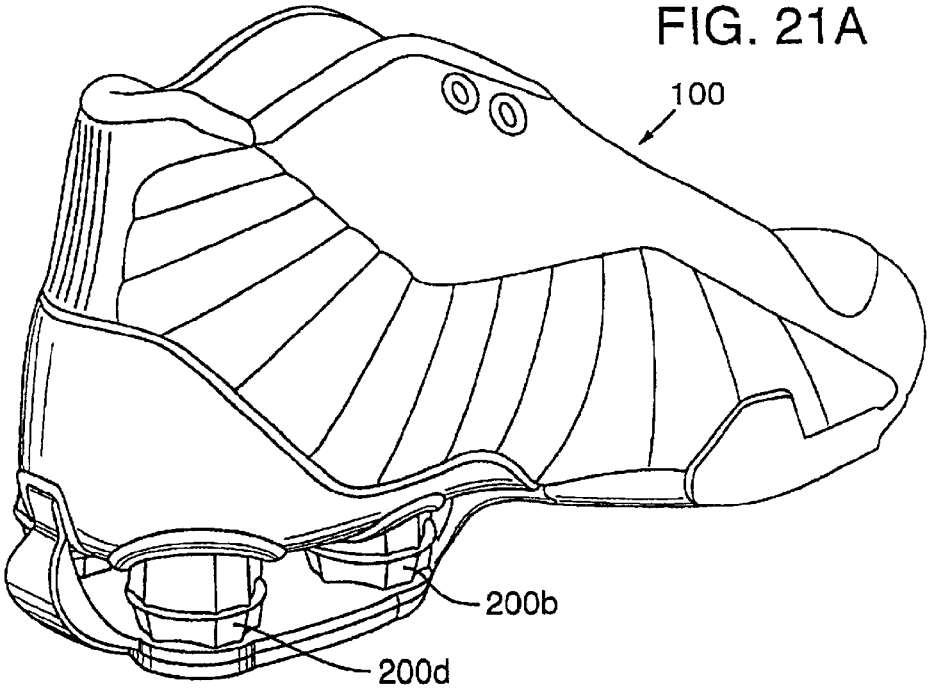
FIG. 21A is a perspective view of a second article of footwear including columns according to the second embodiment of the present invention.
Figure 21B:
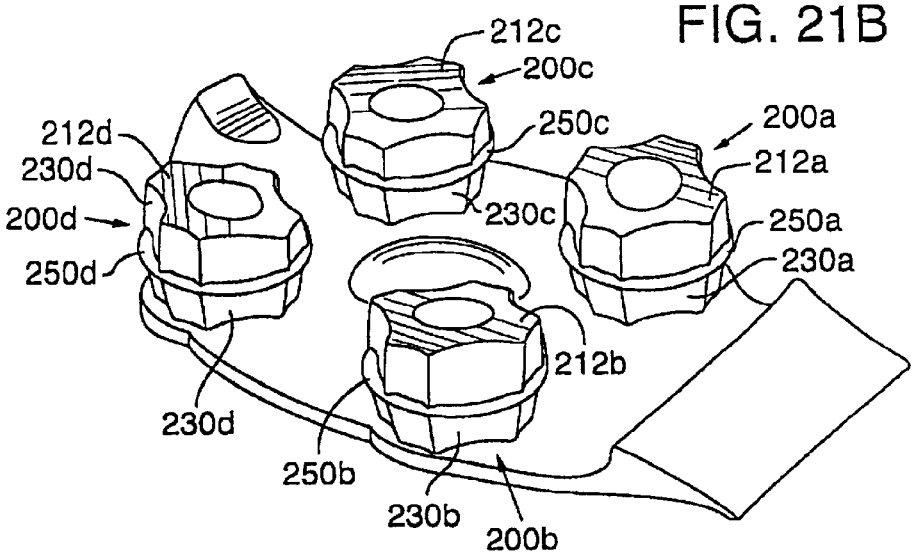
FIG. 21B is a perspective view of a stability component according to the second embodiment of the present invention.
Figure 21C:
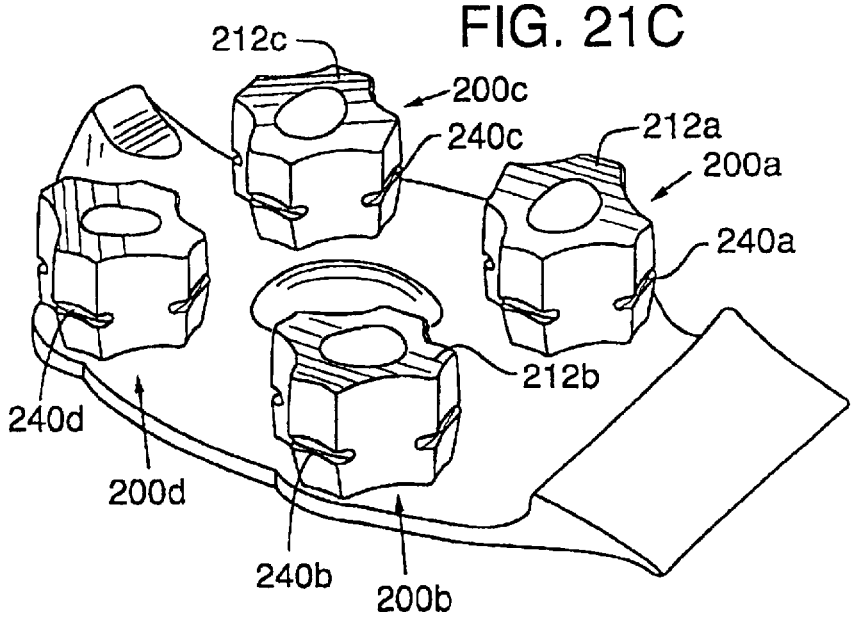
FIG. 21C is a second perspective view of the stability component of 21B.
Figure 21D:
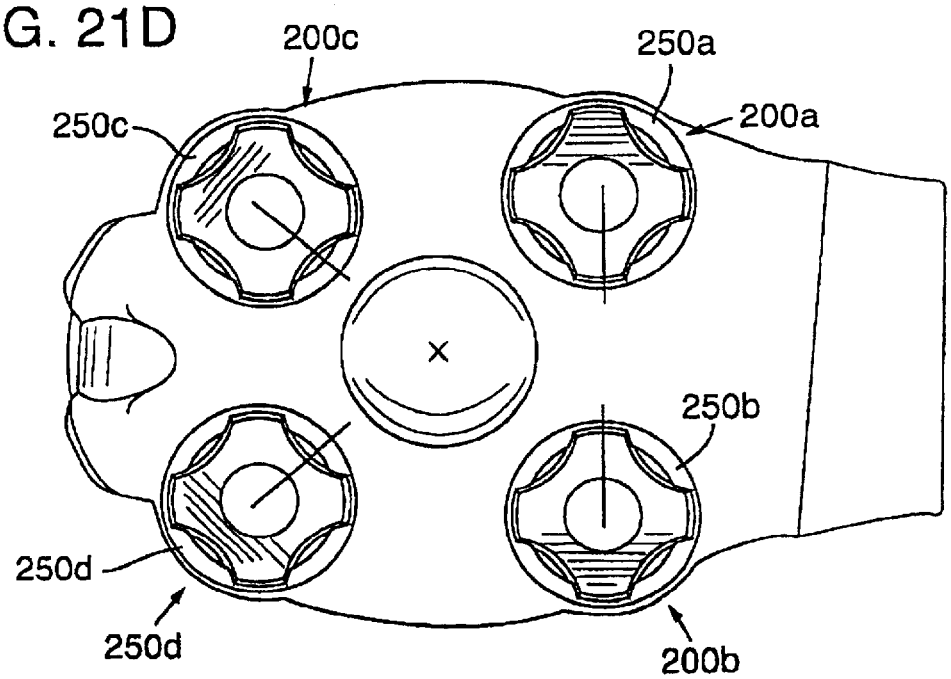
FIG. 21D is a top plan view of the stability component of 21B.

Heel plate 104 is depicted in FIGS. 14–19. Heel plate 104 is molded as a single, semi-rigid component that provides a foundation for aft portions of the wearer's foot and attaches to the upper surfaces of support elements 108. In combination, base portion 146, lateral side wall 148, medial side wall 150, and aft wall 152, form heel plate 104, and serve to counter lateral, medial, and rearward movement of the foot. Base portion 146 is depicted in FIG. 14 and extends from the plantar arch area of the wearer's foot to the plantar heel area. Lateral side wall 148 is shown in FIG. 15 and extends from central portions of the lateral arch area to the lateral heel area. Likewise, medial side wall 150, shown in FIG. 16, extends from central portions of the medial arch area to the medial heel area. The height of lateral side wall 148 and medial side wall 150 increase in the heel region where aft portions of the foot corresponding to the calcaneus are covered. Aft wall 152 bridges the gap between lateral side wall 148 and medial side wall 150, thereby covering the remainder of the aft calcaneus.

For purposes of receiving and attaching to upper surfaces 116 of columns 108*a*–108*d*, base portion 146 includes four raised, circular ridges 154. Raised aft support ridge 156 is positioned on a longitudinal centerline of base portion 146 that corresponds to section 17 of FIG. 14 and receives and attaches to upper surface 128 of aft support 108*e*. Circular ridges 154 and aft support ridge 148 define sites for receiving upper surfaces 116 and upper surface 128 that do not create protrusions on the interior surface of heel plate 104 that may cause discomfort to the wearer.

The material used for heel plate 104 should possess sufficient stiffness to distribute a downward force of a foot to columns 108*a*–108*d*, yet have sufficient compliance to bend downward between columns 108*a*–108*d*. One material having these characteristics is a polyether block copolyamide (PEBA) containing 50% short glass fiber. Such materials display a tensile strength of approximately 5671 psi and a flexural modulus of 492,292 psi. In order to achieve the necessary stiffness and compliance, base portion 146 may have a 1.25 mm thickness up to U.S. men's size 13 and a 1.50 mm thickness in U.S. men's sizes beyond 13.

The features expressed herein form a system that improves lateral stability by utilizing the movements of a wearer, including lateral movement, to center the wearer's foot above sole 106 of shoe 100. The primary stability device is the directed deflection characteristics of support elements 108. One such characteristic lies in the arrangement of columns 108*a*–108*e* such that portions on the exterior of shoe 100 have a greater elevation, due to canted upper surfaces 116, than portions on the interior. Heel plate 104 is then positioned such that the periphery of the calcaneus is above portions of columns 108*a*–108*d* having lesser elevation. This arrangement ensures that the area of maximum stress is on the portions of columns 108*a*–108*e* on the interior of shoe 100, thereby causing columns 108*a*–108*d* to have a deflection bias in the inward direction.

A second directed deflection characteristic of support elements 108 is the presence of flexion indentations 122 on vertical surfaces 118 of columns 108*a*–108*d* that correspond to the <point of lowest elevation on upper surfaces 116. The placement of one or more flexion indentations 122 in this area causes bending of columns 108*a*–108*d* in the directions indicated by arrows 113 and 115. As such, canted upper surfaces 116 and flexion indentations 122 perform cooperatively to stabilize heel plate 104, and thereby the calcaneus of the wearer, above sole 106.

A third directed deflection characteristic of support elements 108 is present in aft support 108*e*. The ratio of the width of lower edge 138 to the distance between fore surface 130 and aft surface 132 is in the range of three to five. As such, aft support 108*e* prevents lateral shearing or bending stresses from acting to move heel plate 104 from the equilibrium position above sole 106.

Heel plate 104 surrounds the bottom, medial, lateral, and aft portions of the wearer's calcaneus, thereby countering independent movement of the heel relative to sole 106. When the wearer's motions create impact forces, heel plate 104 uniformly transfers the impact forces to each support element 108. As such, the deflection bias of support elements 108 interact to significantly prevent movement of heel plate 104 relative to sole 106.

As demonstrated, downwardly canted upper surfaces 116 and flexion indentations 122 of columns 108*a*–108*d*; the design of aft support 108*e*; and the force transferring properties of heel plate 104 and base plate 112 forms a system that provides an article of footwear with high lateral stability. Since each portion of the system contributes to lateral stability, each portion can be used alone or in combination with other portions of the system. Furthermore, bands 126 facilitate adjustments in the stiffness of columns 108, thereby permitting the wearer to configure shoe 100 for the surface upon which shoe 100 is worn or the weight of the wearer, for example.

Support elements in accordance with a second embodiment of the present invention are illustrated in FIGS. 20–25. Each support element 200 includes exterior surface 210, top surface 212, bottom surface 214 and interior void 220. Inscribed longitudinally in exterior surface 210 are one or more access indentations 230, and encircling exterior surface 210 are one or more bands 250. Exterior surface 210 may slope outward from both the top and bottom of support element 200 such that the widest point forms a ridge in the middle of support element 200, thereby ensuring that the point of maximum deflection corresponds with the middle of support element 200. Support elements 200 may have a canted upper surface, as described in reference to columns 108. Accordingly, top surface 212 may be located substantially in the horizontal plane, as in FIGS. 20, or may be canted, as in FIGS. 21.

Exterior surface 210 may also include a structure that removably secures band 250 in one or more positions. As discussed below, the position of band 250 affects the stiffness characteristics of support element 200. Accordingly, it is necessary to ensure that band 250 remains properly positioned during use. As illustrated in FIGS. 20, 21, and 24, one or more band indentations 240 may circumscribe exterior surface 210, thereby providing locations for receiving band 250.

Prior art support elements include bands that are often difficult for the wearer to reposition. In order to facilitate repositioning, support element 200 of the second embodiment of the present invention includes one or more access indentations 230 which permit the wearer to easily gain control of band 250. By dimensioning access indentation 230 such that a gap is present between band 250 and support element 200, thereby ensuring that a wearer's digits may securely contact band 250, the ease with which band 250 may be moved along the length of support element 200 is increased. As depicted, each support element 200 includes four access indentations 230 that are evenly spaced around exterior surface 210.

Band 250, as well as band 126, may be fashioned from a variety of materials that are either rigid or elastic. Compression of support element 200 along its vertical length causes an outward deflection in a direction perpendicular to the longitudinal length. Whether rigid or elastic, band 250 should constrict or otherwise place a uniform inward pressure on exterior surface 210 of support element 200. By restricting outward deflection with band 250, the stiffness of support element 200 is increased in proportion to the inward resistance provided by band 250. In addition to choice of material, the cross-sectional characteristics of band 250 affect stiffness of support element 200. A cross-section having a diameter or thickness of 1 millimeter will impart lesser stiffness than a cross-section having a diameter of 4 millimeters for a given material. Accordingly, the stiffness of support element 200 is affected by the material used to fashion band 250 and the cross-sectional configuration of band 250. Note that in further embodiments band 250 may have a rectangular, oval, or other cross-sectional shape.

Figure 22:
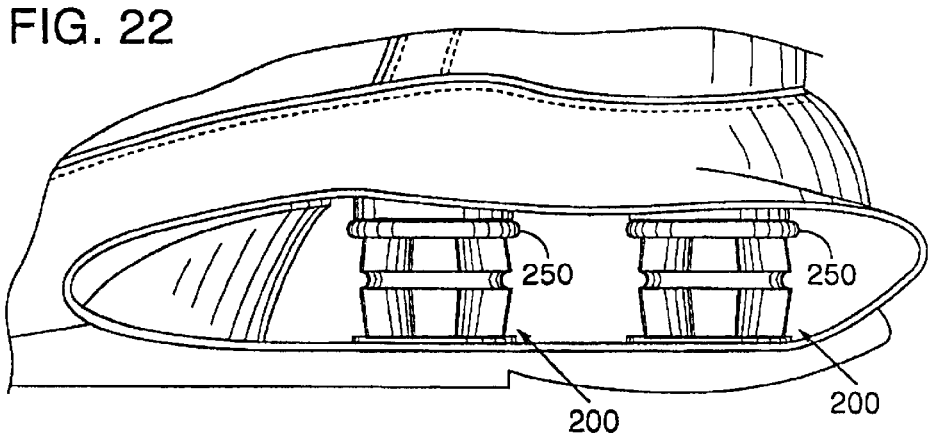
FIG. 22 is a side view of an alternate column configuration that each include a band.

In FIGS. 20 and 21, band indentation 240 is located at the approximate midpoint of support element 200, the midpoint also being the point of maximum deflection. Referring to FIG. 22, band 250 is located adjacent to top surface 212. By positioning band 250 in a location other than the point of maximum deflection, the stiffness of support element 200 is decreased because the inward pressure of band 250 is no longer present at the area of maximum outward deflection. Accordingly, a second factor that affects the stiffness of support element 200 is the position of band 250.

FIGS. 23 depict support elements 200 as having bands 250*x* and 250*y*. Unlike support elements 200 of FIGS. 20 and 21, support elements 200 of FIGS. 23 do not include band indentations 240 for ensuring proper positioning of bands 250. By altering the position of bands 250*x* and 250*y*, the stiffness characteristics of support element 200 are altered accordingly. For example, both band 250*x* and band 250*y* may be located in the area of maximum support element deflection, as depicted in FIG. 23A. In this position, the point of maximum deflection is restricted by both bands 250, thereby configuring support element 200 for maximum stiffness. In conditions where the playing surface is compliant, a wearer may wish to have footwear with maximum sole stiffness. Furthermore, a wearer having a substantially greater mass than the average wearer may require a sole to be configured for maximum stiffness in order to counteract the greater impact forces. The configuration of FIG. 23A would be appropriate for these situations.

Figure 23A:
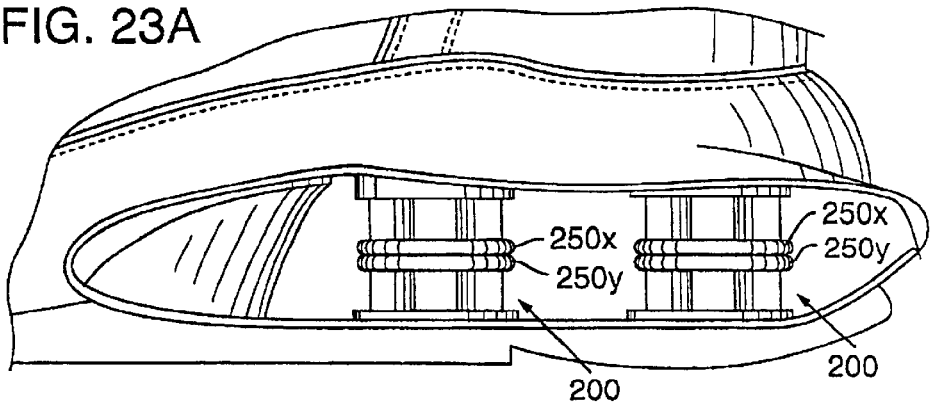
FIGS. 23A–23D are side views of columns having two bands and no band indentations.
Figure 23B:
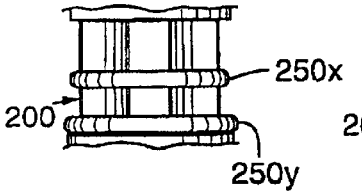
Figure 23C:
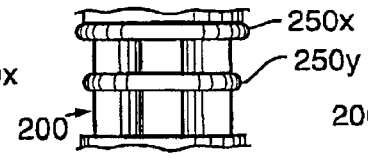

FIG. 23B depicts a configuration wherein band 250×is located in the area of maximum deflection and band 250*y* is in an area of minimal deflection. In this configuration, only band 250*x* has a substantial effect upon the stiffness of support element 250. FIG. 23C depicts a similar configuration wherein band 250*y* is located in the area of maximum deflection and band 250*x* is in an area of minimal deflection. In this configuration, only band 250*y* has a substantial effect upon the stiffness of support element 250. However, the stiffness of support element 250 may be less in the configuration of FIG. 23C than in the configuration of FIG. 23B if band 250*y* is formed of a material that has a lesser stiffness than the material that forms band 250*x*. Accordingly, these configurations may be used for wearers who desire the ability to adjust stiffness with greater precision.

Figure 23D:
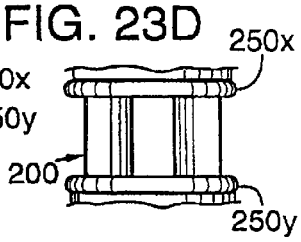
Figure 24A:
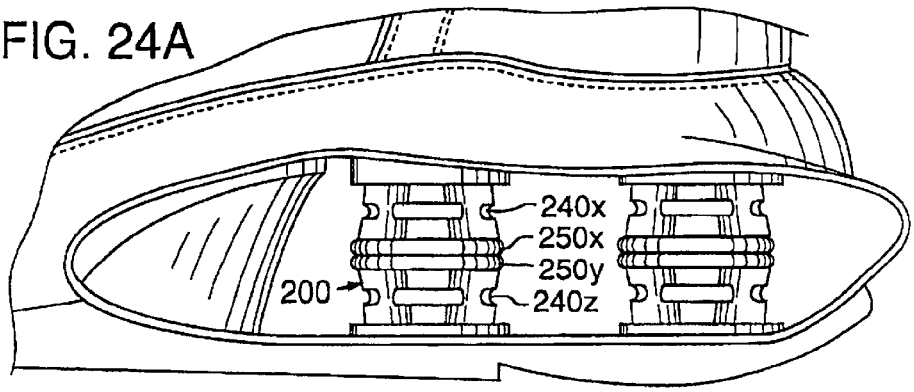
FIGS. 24A–24D are side views of columns having two bands and three band indentations.
Figure 24B:
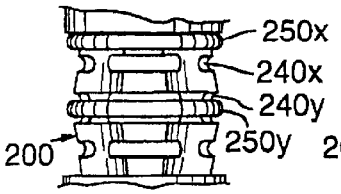
Figure 24C:
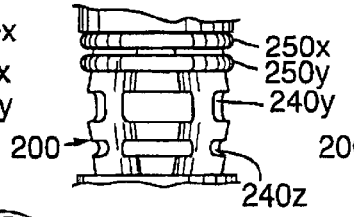
Figure 24D:
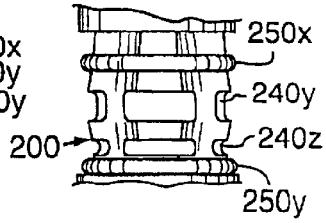

Support element stiffness is minimized by positioning both bands 250 in areas of minimal support element deflection, as in FIG. 23D. This configuration may be utilized if a wearer is significantly lighter than average or if the playing surface is particularly non-compliant. Further alterations in band position or stiffness will have similar effects on the stiffness of support element 200.

FIG. 24 depict a support element 200 having two bands 250 and three band indentations 240. Band indentation 240*x* is located between top surface 212 and the midpoint of exterior surface 210. Band indentation 240*y* is located at the midpoint of exterior surface 210, the point of maximum deflection, and has sufficient width to accommodate two bands 250. Similarly, band indentation 240*z* is located between bottom surface 214 and the midpoint of exterior surface 210. Band 250*x* may be positioned adjacent to top surface 212 or in one of band indentations 240. Similarly, band 250*y* may be positioned adjacent to lower surface 214 or in band indentations 240. Accordingly, there are ten possible configurations for altering the stiffness characteristics of support element 200. Combined with the possibility that band 250*x* and band 250*y* may be formed from materials having differing stiffness characteristics, the arrangement depicted in FIGS. 24 permits support element 200 to be configured for multiple differing stiffnesses. Note that FIGS. 24 show only four of the possible configurations. In addition, additional bands 250 may be added to each support element 200.

Figure 25:
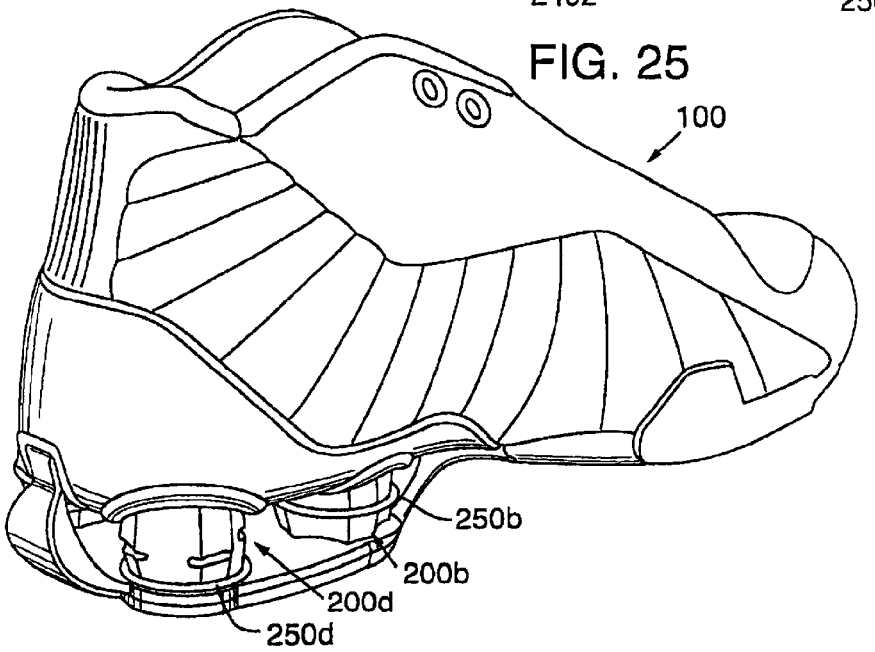
FIG. 25 is a perspective view of an article of footwear including columns according to the second embodiment of the present invention.

It is not necessary that each support element 200 in an individual article of footwear be adjusted so as to have equal stiffness properties. FIG. 25 depicts an article of footwear incorporating four support elements 200. Using such footwear, a wearer that requires increased lateral stiffness may position bands 250 such that lateral support elements 200*a* and 200*c* have a greater stiffness than medial support elements 200*b* and 200*d*. Furthermore, a wearer may adjust stiffness such that rear support elements 200*c* and 200*d* are less stiff than fore support elements 200*a* and 200*b*, as depicted in FIG. 25. Accordingly, the present system permits a wearer of athletic footwear to adjust sole stiffness in order to meet his or her particular stiffness requirements. The presence of access indentations 230 permits an ease of adjustment not present in the prior art.

Although the various configurations of FIGS. 23–25 depict the second embodiment wherein access indentations are present in exterior surface 210, similar concepts regarding the adjustability of support element stiffness are applicable to the first embodiment wherein a flange is attached to the exterior of the band.

The disclosed embodiments include primarily cylindrical support elements and circular bands that encircle the exterior surface of the support elements. In further embodiments, the support elements may have a wide variety of other shapes that require use of a band having noncircular dimensions. For example, a band having a rectangular shape would be used with a rectangular support element. Accordingly, it is not necessary that support elements 200 have a cylindrical configuration or that bands 250 be formed in the shape of a ring.

The present invention is disclosed above and in the accompanying drawings with reference to a variety of preferred embodiments. The purpose served by disclosure of the preferred embodiments, however, is to provide an example of the various aspects embodied in the invention, not to limit the scope of the invention. One skilled in the art will recognize that numerous variations and modifications may be made to the preferred embodiments without departing from the scope of the present invention, as defined by the appended claims.

What is claimed is:

1. An article of footwear comprising:

an upper for receiving a foot of a wearer; and a sole attached to said upper, said sole having at least one support element that includes:

an exterior surface, wherein an upper portion and a lower portion of said exterior surface slope outward to form a ridge that encircles said at least one support element;

at least one band encircling said exterior surface; and a structure different from said at least one band that facilitates movable positioning of said at least one band with respect to said exterior surface to thereby alter deflection and stiffness characteristics of said at least one support element.

2. The article of footwear of claim 1, wherein said structure is attached to said at least one band.

3. The article of footwear of claim 2, wherein said structure is at least one flange extending from said at least one band.

4. The article of footwear of claim 3, wherein said at least one flange is formed integral with said at least one band.

5. The article of footwear of claim 3, wherein said at least one flange is proportioned and positioned such that a hand of the wearer may grasp said at least one flange.

6. The article of footwear of claim 1, wherein said structure is at least one access indentation formed in said exterior surface.

7. The article of footwear of claim 6, wherein said at least one access indentation extends along a longitudinal length of said at least one support element.

8. The article of footwear of claim 6, wherein said at least one access indentation forms a gap between said exterior surface and said at least one band.

9. The article of footwear of claim 6, wherein said at least one access indentation includes a plurality of access indentations.

10. The article of footwear of claim 9, wherein said plurality of access indentations includes four access indentations.

11. The article of footwear of claim 1, wherein said exterior surface includes at least one band indentation that removably receives said at least one band.

12. The article of footwear of claim 11, wherein said at least one band indentation extends laterally around said at least one support element.

13. The article of footwear of claim 1, wherein said at least one support element includes a plurality of support elements.

14. The article of footwear of claim 1, wherein said at least one support element is hollow.

15. The article of footwear of claim 1, wherein a band indentation is formed in said ridge, said band indentation removably receiving said at least one band.

16. An article of footwear comprising:

an upper for receiving a foot of a wearer; and a sole attached to said upper, said sole having at least one support element that includes:

an exterior surface;

at least one band encircling said exterior surface; and at least one flange attached to said at least one band and extending outward from said at least one band, said at least one flange facilitating movable positioning of said at least one band with respect to said exterior surface to thereby alter deflection and stiffness characteristics of said at least one support element.

17. The article of footwear of claim 16, wherein said at least one flange is proportioned and positioned such that a hand of the wearer may grasp said at least one flange.

18. The article of footwear of claim 16, wherein said at least one flange is formed integral with said at least one band.

19. An article of footwear comprising:

an upper for receiving a foot of a wearer; and a sole attached to said upper, said sole having at least one support element that includes:

an exterior surface;

at least one band encircling said exterior surface and being movably positionable with respect to said exterior surface to thereby alter deflection and stiffness characteristics of said at least one support element; and at least one access indentation defined by said exterior surface, said at least one access indentation forming a gap between said exterior surface and said at least one band to facilitate positioning of said band.

20. The article of footwear of claim 19, wherein said at least one access indentation extends along a longitudinal length of said at least one support element.

21. The article of footwear of claim 19, wherein said at least one access indentation includes a plurality of access indentations.

22. The article of footwear of claim 21, wherein said plurality of access indentations includes four access indentations.

23. The article of footwear of claim 19, wherein said exterior surface includes at least one band indentation that removably receives said at least one band.

24. The article of footwear of claim 23, wherein said at least one band indentation extends laterally around said at least one support element.

25. The article of footwear of claim 19, wherein an upper portion and a lower portion of said exterior surface slope outward to form a ridge that encircles said at least one support element.

26. The article of footwear of claim 25, wherein a band indentation is formed in said ridge, said band indentation removably receiving said at least one band.

27. An article of footwear comprising:

an upper for receiving a foot of a wearer; and a sole attached to said upper, said sole having at least one support element that includes:

an exterior surface;

a first band encircling said exterior surface and being movably positionable with respect to said exterior surface to thereby alter deflection and stiffness characteristics of said at least one support element;

at least one access indentation defined by said exterior surface, said at least one access indentation forming a gap between said exterior surface and said first band to facilitate positioning of said first band; and a securing device for removably securing a position of said first band.

28. The article of footwear of claim 27, wherein said at least one access indentation extends along a longitudinal length of said at least one support element.

29. The article of footwear of claim 27, wherein said at least one access indentation includes a plurality of access indentations.

30. The article of footwear of claim 29, wherein said plurality of access indentations includes four access indentations.

31. The article of footwear of claim 27, wherein said securing device includes a first band indentation that removably receives said first band.

32. The article of footwear of claim 31 wherein said at least one support element includes a second band.

33. The article of footwear of claim 32, wherein said at least one support element has a first stiffness when said first band and said second band are disposed in said first band indentation, said support element has a second stiffness when only one of said first band and said second band are disposed in said first band indentation, and a third stiffness when neither said first band nor said second band are disposed in said first band indentation, said first stiffness being greater than said second stiffness and said second stiffness being greater than said third stiffness.

34. The article of footwear of claim 32, wherein said first band has a greater stiffness than said second band.

35. The article of footwear of claim 27, wherein said securing device includes a first band indentation and a second band indentation, said first band indentation and said second band indentation removably receiving said first band.

36. The article of footwear of claim 35, wherein said support element has a first stiffness when said first band is disposed in said first band indentation and said support element has a second stiffness when said first band is disposed in said second band indentation, said first band indentation being located at a longitudinal center of said support element and said second band indentation being located between an end of said at least one support element and said first band indentation.

* * * * *